United States Patent [19]

Wood

[11] Patent Number: 4,625,530

[45] Date of Patent: Dec. 2, 1986

[54] WIRE PREFORM APPARATUS

[75] Inventor: Gary L. Wood, Salisbury, N.C.

[73] Assignee: The B. F. Goodrich Company, Akron, Ohio

[21] Appl. No.: 772,279

[22] Filed: Sep. 3, 1985

[51] Int. Cl.[4] ..... B21C 47/00; B21F 3/00

[52] U.S. Cl. ..... 72/146; 156/143

[58] Field of Search ..... 72/46, 135, 142, 146, 72/148, 183, 280, 289; 156/143, 144

[56] References Cited

U.S. PATENT DOCUMENTS

| | | | |
|---|---|---|---|
| 3,212,528 | 10/1965 | Haas | 138/130 |
| 3,618,357 | 11/1971 | Beninga | 72/289 |
| 4,196,031 | 4/1980 | Lalikos et al. | 156/143 |
| 4,444,707 | 4/1984 | Schwarz | 156/144 X |

FOREIGN PATENT DOCUMENTS

| | | | |
|---|---|---|---|
| 57-70021 | 4/1982 | Japan | 72/289 |
| 2078583 | 1/1982 | United Kingdom | 72/289 |

*Primary Examiner*—E. Michael Combs

*Attorney, Agent, or Firm*—Joseph Januszkiewicz

[57] ABSTRACT

Disclosed is an apparatus to preform wire into helical configurations wherein the wire will be used in flexible wire reinforced rubber hose. The apparatus includes a wire shaping mechanism that utilizes a grooved rotatable cylindrical preform roller which is capable of preforming a plurality of wires into a desired helical shape. Thereafter, the helically shaped wires are wound onto a motor driven windup creel.

7 Claims, 6 Drawing Figures

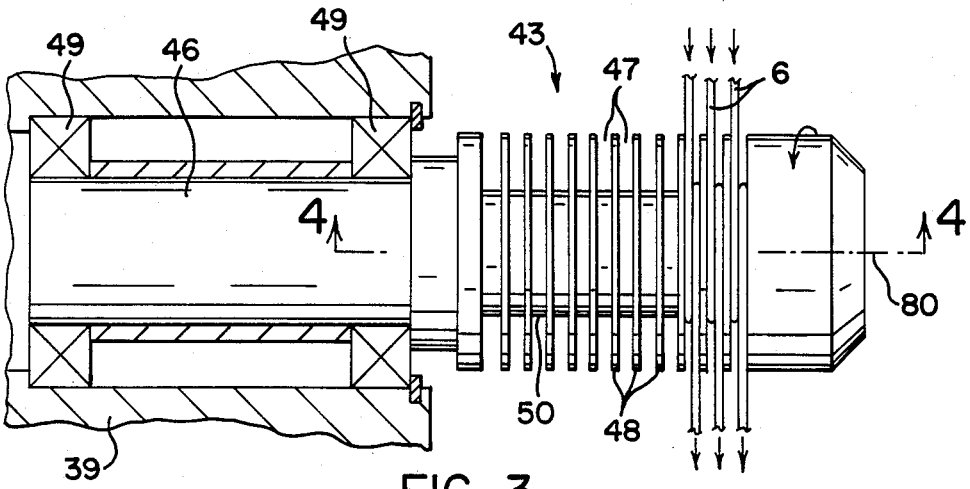
FIG. 3
FIG. 4
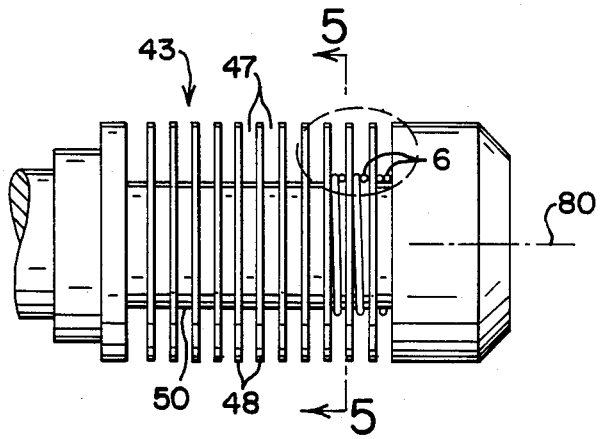
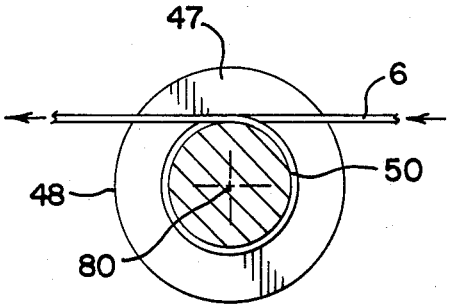
FIG. 5
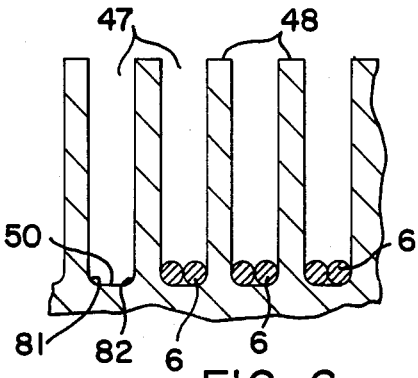
FIG. 6

WIRE PREFORM APPARATUS

BACKGROUND OF THE INVENTION

This invention relates to the manufacture of flexible wire reinforced rubber hose and, in particular, to an apparatus to preform the wire used in the flexible wire reinforced rubber hose.

Rubber hose reinforced with one or more plies of resilient wires and a method to manufacture such hose are described, for example, in U.S. Pat. No. 3,212,528. Such hose includes a plurality of layers of an elastomeric material and layers or plies of resilient steel wires which are disposed in helical convolutions. Successive wire plies are insulated from each other by elastomeric material or elastomer treated fabric, plastics, or other flexible material.

The preforming or shaping of the wire into helical convolutions is effected by bending portions of the wire over suitable contoured surfaces under sufficient tension to cold work the wire and impart to the wire an inherent tendency to take the shape of a helix of the particular size desired.

The shape of the helical convolutions of the wire can be described in terms of its diameter and the orientation of the helical convolutions. The term "neutral lay" is used to describe the helical shape an individual helical-shaped wire would take if free from any external deforming forces. The term "diameter" with reference to the neutral lay means the outer diameter of the wire helix under strain-free conditions from one side of the helix to a plane surface on which the opposing portions of the convolutions rest. In general, a wire can be formed to a pitch that is oriented helically in either right-handed (clockwise) or left-handed (counterclockwise) directions.

In one manufacturing process for a hose containing a multiplicity of wires, as described in the '528 patent, each wire is transferred from a wire supply consisting of a spool onto a particular hose wherein the preform operation is done on the same machine (a standing machine) as the hose is manufactured on. This wire shaping operation is carried out just ahead of the point where each wire is wound onto the hose by guiding each wire over a suitably contoured edge, whereby each wire is helically formed. In general, the wires are trained under equal uniform tension from the wire supply whereafter the wires are attached to the surface of the portion of the hose carcass on which the ply is to be formed. The portions of the wires near the hose carcass are gathered into an array converging concentrically toward the hose carcass as the array approaches the location where it is progressively wrapped on the carcass.

In order to preform wire, the wire generally must have a certain minimum tension between the wire supply and the winding point. However, the changing diameter of the wire on the spool results in varying tensile forces applied to the wire which steadily increase as the diameter of the coil of wire on the spool decreases in the course of production and, thereby, give rise to changing spiraling forces.

Adjustment of the spool braking forces is difficult or possible only at very great cost. As shown in the '528 patent, the spools are arranged in a circle on a revolving stranding disc. The brakes of the spool must be firmly preset manually before production gets underway. In actual practice, this has a detrimental effect on precise maintenance on the hose diameter.

It has been suggested that separation of the preform operation from the production of the hose, as described in U.S. Pat. No. 4,444,707, can somewhat improve the production of the hose by making the hose production independent of the preform operation. However, to preform a plurality of wires as described in the '707 patent, a plurality of precoiling structures are required to be located side by side. Such an arrangement has the disadvantages of the manpower required to thread the individual preform devices.

Also, the stationary preform edge as described in the '707 patent can result in increased friction between the wire and the edge. Such friction has a detrimental effect on brass covered wire whereby the brass is removed. Also, the friction between the wire and edge requires additional power to wind the wire and further requires a spool of sufficient weight to counteract the compressive forces on the spool resulting from the friction.

SUMMARY OF THE INVENTION

It is an object of the present invention to provide an improved apparatus for preforming a wire used in the manufacture of flexible wire reinforced rubber hose.

The apparatus of the present invention includes a wire supply means; a wire shaping mechanism comprising a wire shaping mechanism support means, a rotatable cylindrical preform roller mounted to the support means, the preform roller includes a groove which has a minor diameter. The preform roller is positioned for engagement of the wire in the groove wherein the wire is shaped about the minor diameter; and a windup means where the preformed wire is deposited.

The apparatus of the present invention for preforming wire can be used for a plurality of wires resulting in uniform spacing of the wires which leads to uniform tension applied to the plurality of wires. In addition, the resistance or friction against the wire at the preform roller has been reduced, thereby reducing the amount of wire wear during the preform operation as well as the power to wind up the wire.

BRIEF DESCRIPTION OF THE DRAWINGS

FIG. 3 is a further enlarged top view of the preform roller shown in FIG. 2;

FIG. 4 is a side view of the preform roller taken along line 4—4 of FIG. 3;

FIG. 5 is a cross sectional view of the preform roller taken along line 5—5 of FIG. 4;

FIG. 6 is an enlarged partial cross sectional side view of a portion of the preform roller taken from FIG. 4.

DETAILED DESCRIPTION

Figure 1:
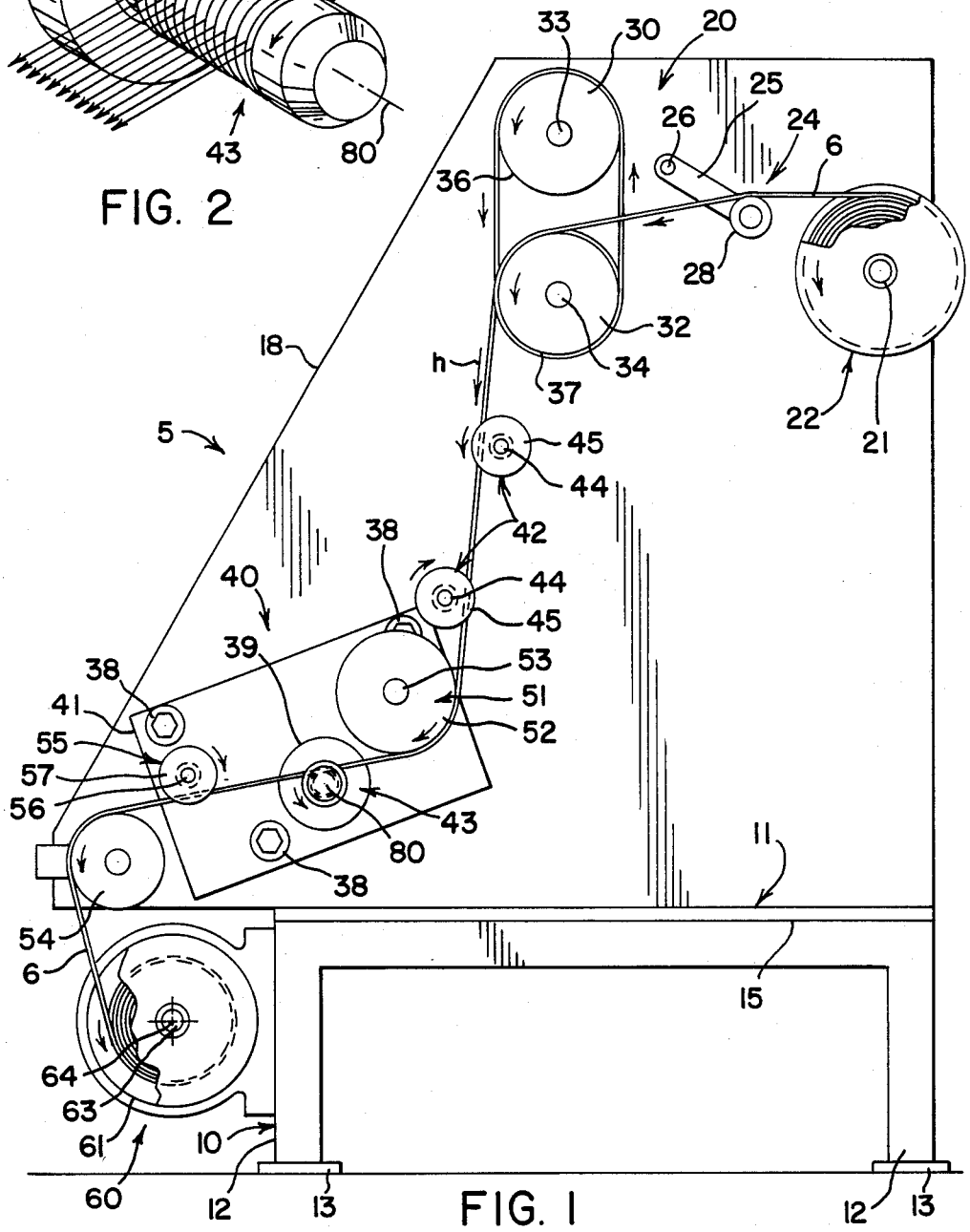
FIG. 1 is a side view of a preform apparatus in accordance with a presently preferred embodiment of the invention.

In FIG. 1, an apparatus 5 to preform wire according to the invention is shown in a presently preferred embodiment. The apparatus 5 comprises a frame 10, a wire supply means 20, a wire shaping mechanism 40 and a wire windup means 60. The apparatus 5 is shown to preform one wire 6. However, as shown in FIGS. 2, 3, 4 and 6, the apparatus 5 can be adapted to preform a plurality of wires.

The frame 10 includes an upper horizontal table 11 and four vertical support members or legs 12 each having a foot 13 to support the frame 10. The table 11 includes a bottom face 15 which is welded or otherwise secured to the top of each leg 12. A vertical plate 18 is mounted on the table 11 to allow the wire supply means 20 and wire shaping mechanism 40 to be attached thereto. The wire windup means 60 is attached to the frame 10.

The wire supply means 20 as shown in FIG. 1 includes a spool 22 containing a single wire supply, a lever system 24 and a braking mechanism (not shown) to maintain uniform tension on the wire (6), and a round spool support shaft 21 which is mounted on and supported by the vertical plate 18. The spool 22 is rotatably mounted on and supported by the spool support shaft 21. To preform a plurality of wires, the apparatus 5 can be designed with a plurality of spools, with associated means to maintain uniform tension on each wire and a corresponding plurality of spool support shafts.

The lever system 24 includes an arm 25 pivotable about a pin 26 which is suitably mounted on the vertical plate 18. Attached to the arm 25 is a rotatable roller 28 over which the wire 6 passes. Pivotal movement of the arm 25 is measured by transducers (not shown) which generate electrical signals. The signals are sent to a servo mechanism (not shown) attached to a braking mechanism (not shown) of the spool 22. The pivotal arm 25 movement directly controls the braking mechanism of the spool 22 thereby maintaining uniform tension on the wire 6.

The wire 6, coming off the supply spool 22, is first passed over the roller 28. High tension on roller 28 results in the brake to be partially released allowing the spool to turn faster and low tension on roller 28 results in braking of the spool, slowing the speed of the spool. Other braking means such as disclosed in the '707 patent which measures the wire tension electronically and uses the measurements to control an electromagnetic or pneumatic diaphragm brake may be used to control the braking of the supply spool 22.

The wire supply means 20 further includes a pair of metering reels 30, 32 which are rotatably mounted on corresponding shafts 33, 34 which are bolted or attached by suitable means to the vertical plate 18. Each metering reel 30, 32 contains an outer radial circumferential surface 36, 37 which contains a groove (not shown) for the wire 6 or may contain a plurality of grooves wherein each groove is associated with one wire. A measuring device (not shown) may be attached to metering reel 32 to measure the length of wire that passes over the metering reel 32. Also, a conventional means (not shown) to detect breakage of the wire can be located between the supply means 20 and the wire shaping mechanism 40.

The wire shaping mechanism 40 as shown in FIG. 1 includes a support means 41, a pair of stationary combs 42; a first guide roller 51; a cylindrical rotatable preform roller 43; a stationary comb 55 and a second guide roller 54. The support means 41 is removably attached by bolts 38 or attached by other conventional means to the vertical plate 18 in order to facilitate change to other various shaping mechanisms of different sizes.

Each of the stationary combs 42 include a support shaft 44 fixed or secured in a conventional manner to the vertical plate 18. Mounted on the shaft 44 is a grooved cylindrical roll 45 which is designed to guide the wire 6 or is designed with a plurality of grooves to guide and separate a plurality of wires so that the wires do not intermix.

The guide roller 51 is positioned at a location along the path the wire 6 follows between the stationary comb 42 and the preform roller 43 where the wire makes a directional change of about 90°. The guide roller 51 includes a smooth cylindrical roll 52 rotatably mounted on a shaft 53 by suitable means such as bearings. The shaft 53 is bolted or attached by suitable means to the vertical plate 18.

The preform roller 43, as shown in detail in FIGS. 2, 3, 4, 5, and 6, includes grooves 47, projections 48, minor diameter 50, a journal 46 which is secured by bearings 49 in a housing 39 of the support means 41. The preform roller 43 is rotatable about a horizontal axis 80. Each groove 47 contains two radii of curvature 81, 82 as shown in FIG. 6. The radii of curvature, 81, 82, are about 0.25 inch (0.64 cm). The grooves 47 and the projections 48 of the preform roller 43 have a surface area which has a finished Rockwell hardness of between about 59 to about 63 to resist wear from the wire 6.

The grooves 47 are designed to a width of at least twice the width of the wire 6 to enable the wire 6 to circumferentially wrap around the minor diameter 50 as shown in FIGS. 2, 3, 4, and 5. The width of the minor diameter 50 determines the diameter of the helically coiled wire. It has been found, for example, that a minor diameter 50 of 0.87 inch (2.2 cm) results in 0.015 inch (about 0.038 cm) and 0.018 inch (about 0.046 cm) brass plated wire to contain a 3 inch (7.62 cm) neutral lay diameter.

A stationary comb 55 is attached by suitable means to the support means 41 and is similar to the stationary combs 42. The stationary comb 55 includes a support shaft 56 and a grooved cylindrical roller 57 which is designed to guide the preformed wire 6 or is designed with a plurality of grooves to guide and separate a plurality of preformed wires.

The wire windup means 60 as shown in FIG. 1 comprises a rotatable spool 61, a drive means (not shown) and a rotatable spool support shaft 63. The wire windup means 60 is mounted on and supported by the frame 10. The spool 61 is mounted on and supported by the spool support bar 63. The spool support bar 63 is rotated about a horizontal axis 64 by the drive means such as a motor or other conventional means. To maintain a constant and uniform wire winding rate, the winding rate of the wire windup means 61 can be controlled by the rpm of one of the metering reels 30, 32. The wire windup means 60 is suitably designed to windup the wire 6 or a plurality of wires.

Figure 2:
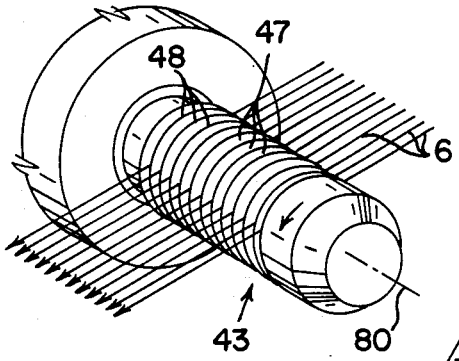
FIG. 2 is an enlarged perspective view of a preform roller used in the apparatus of FIG. 1.

Preforming a wire 6 on apparatus 5 begins by threading the wire in the direction h as shown in FIG. 1. The wire 6 is precoiled or formed into helices by being passed circumferentially around the minor diameter 50 of the preform roller 43. FIGS. 2, 3, and 6 are various views of the preform roller 43 showing a plurality of grooves 47 with corresponding wires. Depending on whether the wire 6 is to be coiled left handed or right handed, it is run either over the minor diameter 50 from top to bottom to top for a left-handed helix or from bottom to top to bottom around the minor diameter 50 for a right-handed helix.

Wires which may be used in making flexible wire reinforced rubber hose are preferably monofilamentary high tensile cold drawn spring steel wire. This so-called "music" quality steel wire having a diameter ranging from about 0.010 inch (0.0254 cm) to about 0.050 inch (0.125 cm) has a tensile strength at the yield point of about 200,000 pounds per square inch (585,200 kilograms per square cm) to about 425,000 pounds per square inch (1,243,550 kilograms per square cm) may be used. Preferably, the present invention is suitable for wire having a diameter ranging from about 0.010 inch (0.0254 cm) to about 0.022 inch (0.056 cm). An important property of the wire is high grease resistance to improve bonding of the wire to rubber. If the wire is excessively greasy or dirty, it may be passed through a suitable washing solution. An alternative is to coat the wire with brass.

In the foregoing description of the wire shaping mechanism 40, it is explained that each wire is shaped into a permanent helical coil by bending it under substantial tension around minor diameter 50 and then coiling it onto a windup spool 60. For a wire of a particular size, the diameter of the resulting helical coil into which the wire is shaped is principally influenced by the tension in the wire as it is shaped and by the radial cross sectional curvature of the surface of the minor diameter about which the wire is bent.

The radial cross sectional curve of the wire engaging surfaces for the minor diameter 50 of the preformed roller 43 is such that each wire is deflected substantially beyond its elastic limit as it is bent around the minor diameter 50. Accordingly, the curvature of the wire engaging surfaces of the minor diameter 50 imparts twisting and cold working.

It has been found that the diameter of the neutral lay formed from wire of a given size by the preform roller 43 can be changed by varying the tension in the wire. Increasing the tension on the wire intensifies the cold working imposed on the wire as it is deflected. Therein the diameter of the neutral coil is increased.

Another way of varying the diameter of the neutral lay formed by the shaping mechanism 40 is to substitute a preform roller of different minor diameter. A particular wire under a given tension can be formed into a neutral lay of smaller diameter by using a roller of smaller minor diameter the comparison being relative to any arbitrarily selected roller.

It will be understood that certain departures from and modifications to the preferred embodiment described are possible within the scope of the invention which is to be measured by the following claims.

I claim:

1. An apparatus for forming a helically shaped wire which is used in flexible wire reinforced hose, the apparatus comprising a frame, a wire supply means mounted on said frame for rotation about a first axis; a wire-shaping mechanism comprising a wire shaping support means mounted on said frame, a rotatable cylindrical preform roller mounted on said support means for rotation about an axis parallel to said first axis, said preform roller comprising at least one groove having a minor diameter, said preform roller is positioned for the engagement of the wire in the groove about the minor diameter; and a windup reel mounted on said frame for rotation about an axis parallel to said first axis for tensioning said wire from said preform roller and for winding up the helically formed wire thereon.

2. An apparatus for forming a helically shaped wire as set forth in claim 1 wherein said groove is at least twice the width of the wire.

3. An apparatus for forming a helically shaped wire as set forth in claim 2 wherein said support means is a removable member to facilitate the acceptance of a preform roller of different size to facilitate the processing of different caliber wire.

4. An apparatus for forming a helically shaped wire as set forth in claim 3 wherein guide means fore and aft of said preform roller maintain the path of movement of wire to and from said preform roller along a linear path that is tangential to said preform about which such wire passes.

5. An apparatus for forming a helically shaped wire as set forth in claim 4 wherein said guide means are mounted on said support means for simultaneous replacement with said preform roller.

6. An apparatus for forming a helically shaped wire as set forth in claim 4 wherein a stationary comb is positioned adjacent said wire supply means and said guide means aft of said preform roller is positioned adjacent to said preform roller.

7. An apparatus for forming a helically shaped wire as set forth in claim 6 wherein the remaining one of said guide means is a stationary comb positioned adjacent said preform roller.

* * * * *